United States Patent [19]

Ode et al.

[11] Patent Number: 4,543,692

[45] Date of Patent: Oct. 1, 1985

[54] CLASP FOR ORNAMENTS

[75] Inventors: Sadao Ode; Toshikazu Hatsuse, both of Tokyo; Hiroshi Shiina, Saitama, all of Japan

[73] Assignee: Citizen Watch Co., Ltd., Tokyo, Japan

[21] Appl. No.: 547,733

[22] Filed: Oct. 31, 1983

[30] Foreign Application Priority Data

Dec. 28, 1982 [JP] Japan ..... 57-198881[U]

[51] Int. Cl.[4] ..... A44B 19/00

[52] U.S. Cl. ..... 24/616; 24/163 K; 63/20

[58] Field of Search ..... 24/616, 163 K; 63/20

[56] References Cited

U.S. PATENT DOCUMENTS

| | | | |
|---|---|---|---|
| 1,170,778 | 2/1916 | Nielsen | 24/616 |
| 1,794,333 | 2/1931 | Guyot | 24/616 |
| 1,957,141 | 5/1934 | Jordan | 24/616 |
| 2,152,119 | 3/1939 | White | 24/163 K |
| 2,396,160 | 3/1946 | Coulter et al. | 63/20 X |
| 2,986,792 | 6/1961 | Wyatt | 24/616 |
| 3,225,406 | 12/1965 | Levy | 24/616 |
| 3,969,836 | 7/1976 | Du Bois | 24/163 K X |
| 4,426,854 | 1/1984 | Geldwerth et al. | 24/616 X |

FOREIGN PATENT DOCUMENTS

| | | | |
|---|---|---|---|
| 714237 | 11/1941 | Fed. Rep. of Germany | 63/20 |

*Primary Examiner*—William E. Lyddane
*Assistant Examiner*—Peter A. Aschenbrenner
*Attorney, Agent, or Firm*—Koda and Androlia

[57] ABSTRACT

A clasp for an ornament including a clasp body connected to one end of the ornament, and an engaging member connected to the other end of the ornament. The engaging member is adapted to be lockingly secured in the clasp body. The clasp body is divided into a housing and a cover having an ornamental portion such as a letter, mark and pattern, for ease of replacement of the cover.

3 Claims, 7 Drawing Figures

CLASP FOR ORNAMENTS

BACKGROUND OF THE INVENTION

1. Field of the Invention

This invention relates to a clasp for ornamental links such as a necklace, pendant, bracelet and watch band.

2. Prior Art

For such a clasp, a bolt ring as shown in FIG. 1 has long been used. This type of clasp has an opening 1; a tube 2; a filler 3 filled in the tube 2 leaving both ends of the tube hollow, one hollow end being formed much longer than the other; a spring 4 loaded in the longer hollow end of the tube 2; a tongue 5 inserted in part of the hollow end under the tension of the spring 4 for opening and closing the opening 1; a knob 6 fixed to the tongue 5; and a narrow groove 7 formed in a surface of the tube 2, in which by sliding the knob 6 along the groove 7, the tongue 5 slides along the hollow end under the action of the spring 4 to open and close the opening 1. This clasp prevents, e.g. a valuable necklace made of gold, platinum or their alloy, from coming off and missing when worn. However, drawbacks of this type of clasp include: It is difficult not only to handle the tiny knob 6, but also to pass a link 8 connected to an ornament through the opening 1, and on the other hand, this clasp is easy to break. In addition, its simple shape offers little design variations.

SUMMARY OF THE INVENTION

This invention has been produced from the viewpoint of the aforementioned drawbacks. The object of the invention is to provide a clasp which has a function of securely fastening when worn and is easy to handle, and which offers design variations and is intended to increase the efficiency of manufacturing processes. In accordance with this invention, a clasp for an ornament such as a necklace, pendant, bracelet and watch band is provided which comprises a clasp body connected to one end of the ornament; and an engaging member connected to the other end of the same and having a slot therein, the engaging member being adapted to be lockingly secured in the clasp body, the clasp body including a housing having grooves, and a cover having, on its surface, an ornamental portion such as a letter and pattern, and on its sides, projecting portions for engaging the grooves in the housing, and a lug for engaging the slot in the engaging member, the cover being replaceably formed.

BRIEF DESCRIPTION OF THE INVENTION

DESCRIPTION OF THE PREFERRED EMBODIMENT

Figure 1:
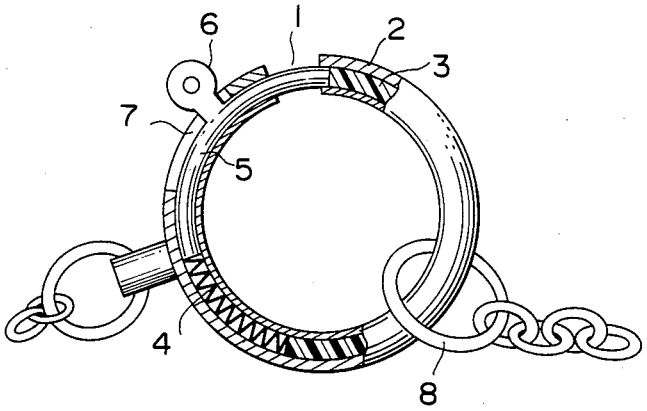
FIG.1 PRIOR ART
FIG. 1 is a front view of one embodiment of a prior art clasp.
Figure 2:
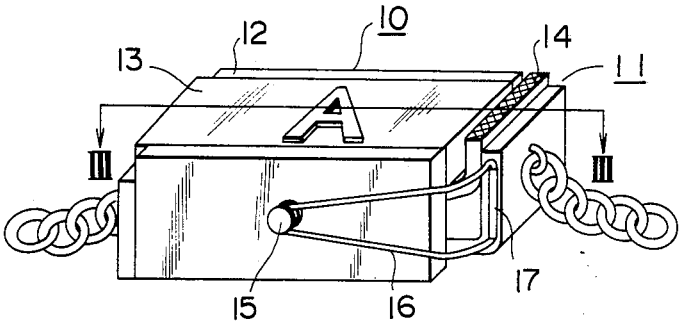
FIG. 2 is a perspective view of one embodiment of a clasp in accordance with the invention.
Figure 3:
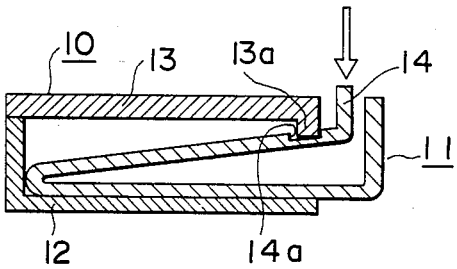
FIG. 3 is a sectional view taken along line III—III of FIG. 2.

Referring to the attached drawings, an embodiment of a clasp in accordance with the invention will be described:

As shown in FIGS. 2 and 3, the clasp of the invention has a structure comprising a clasp body 10 connected to one end of a necklace and an engaging member 11 connected to the other end thereof. The clasp body 10 comprises a housing 12 and a cover 13 having a lug 13*a* at one end. By inserting the engaging member 11 into the clasp body 10, as shown in FIG. 3, the lug 13*a* lockingly engages a slot 14*a* formed in a part of the engaging member 11.

Figure 4:
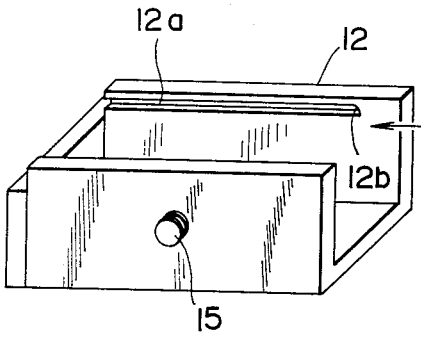
FIG. 4 is a perspective view of a housing forming a part of the clasp in accordance with the invention.
Figure 5:
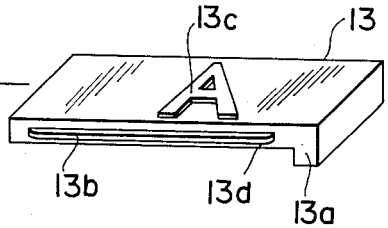
FIG. 5 is a perspective view of a cover which engages the housing of FIG. 4.
Figure 6:
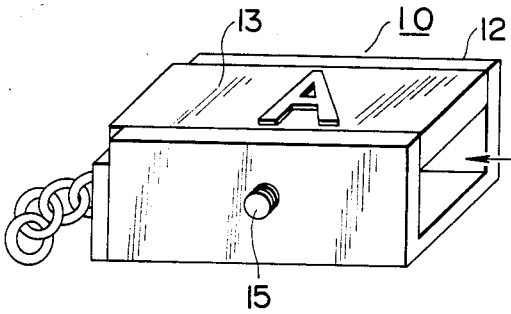
FIG. 6 is a perspective view of the entire clasp body with the cover of FIG. 5 engaging the housing of FIG. 4.

Referring now to FIG. 4, the housing 12 is provided at its opposite inner sides with grooves 12*a* for engaging respective projecting pieces 13*b* of the cover 13 (FIG. 5). Each of the grooves 12*a* is formed halfway of each side plate of the housing 12. While the cover 13 is being inserted, both the side plates of the housing 12 are deformed elastically, and once in position, the cover 13 will not come off the housing 12. Both the housing 12 and the cover 13 make the clasp body 10 in the form of a box as shown in FIG. 6.

A knob 15 on the housing 12 is used for safety lock and engages a locking spring 16 (FIG. 7) on the engaging member 11 after the engaging member 11 is inserted into the clasp body 10.

In FIG. 5, the cover 13 is provided on both sides with the aforementioned projecting pieces 13*b* for engaging the grooves 12*a* in the housing 12 and also on its surface with an ornamental portion 13*c* such as a letter, mark and pattern.

Figure 7:
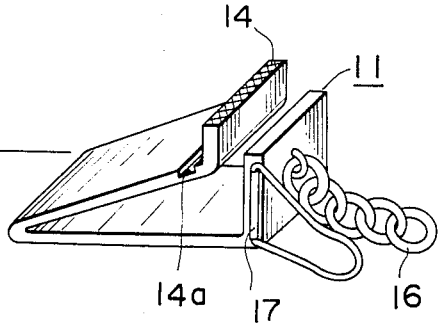
FIG. 7 is a perspective view of an engaging member which is adapted to be lockingly secured in the clasp body of FIG. 6.

The engaging member 11 in FIG. 7 having a bent portion 14 is formed by bending a plate and capable of elastic deformation. The locking spring 16 is fit in a pipe 17 and rotatably supported on the center axis of the pipe 17.

As mentioned above, the cover 13 and the housing 12 form the clasp body 10 as a box, and in the engaged condition between the grooves 12*a* and the projecting pieces 13*b*, the cover 13 will not come off the housing 12 by usual handling. Each of the grooves 12*a* in the housing 12 is rounded at its closed end 12*b* and each of the projecting pieces 13*b* engaging each groove 12*a* is also rounded at its corner 13*d* correspondingly, so that in the usual engaged condition they will not slip off but at the time of replacement they can be separated by pulling out the cover 13 strongly. When the engaging member 11 is inserted into the clasp body 10, the bent portion 14 is elastically deformed to cause the slot 14*a* and the lug 13*a* to engage lockingly. To disengage the lug 13*a* from the slot 14*a*, the bent portion 14 is depressed in the direction of the arrow (FIG. 3).

Conventionally, for example, if a buyer for a necklace desires to have an initial engraved or chased on it, it would take several days, but in accordance with the structure of the invention, the covers can be prepared in advance having ornamental portions of a variety of design so that they can be replaced at the time of purchase, thus meeting conveniently the buyer's desire.

Furthermore, the clasp body 10 divided into the housing 12 and the cover 13 makes it possible to take press operations remarkably in the manufacture, reducing the number of machining processes. Thus this invention has a great effect on practical use.

Although in this embodiment, the cover 13 is designed so that the separate ornamental portion 13*c* of an initial letter is secured thereon, this invention is not limited to this structure, and the ornamental portion 13*c* can be combined with some patterns by means of engraving, chasing or the like. Also, letters or marks of the ornamental portion 13*c* may be formed of metal such as gold or platinum different from that of the cover 13.

In addition, the cover 13 may be formed of a laminated plate of different metals such as gold and platinum, and by engraving or the like, the ornamental portion 13*c* may be indicated with a different color, thereby providing design variations.

What is claimed is:

1. A clasp for an ornament such as a necklace, pendant, bracelet and watch band comprising: a clasp body connected to one end of said ornament; and an engaging member connected to the other end of the same and having a slot therein, said engaging member being adapted to be lockingly secured in said clasp body, said clasp body including a housing having grooves, and a cover having, on its surface, an ornamental portion such as a letter and pattern, and on its sides, projecting pieces for engaging the grooves in said housing, and a lug for engaging the slot in said engaging member, said cover being replaceably formed.

2. A clasp according to claim 1 wherein said engaging member has a locking spring and said housing has a knob for engaging said locking spring.

3. A clasp according to claim 1 wherein each of the grooves in the housing is rounded at its closed end and each of the projecting pieces engaging each groove is also rounded at its corner correspondingly.

* * * * *